United States Patent [19]

Bergstrom et al.

[11] 4,348,256

[45] Sep. 7, 1982

[54] PROCESS FOR CONTROLLING THE SUPPLY OF DELIGNIFYING AND/OR BLEACHING CHEMICALS IN THE CONTINUOUS DELIGNIFICATION OF LIGNOCELLULOSIC MATERIAL

[75] Inventors: John R. Bergstrom, Domsjo; Sten L. Haggstrom, Overnornas, both of Sweden

[73] Assignee: Mo och Domsjo Aktiebolag, Ornskoldsvik, Sweden

[21] Appl. No.: 903,267

[22] Filed: May 5, 1978

[30] Foreign Application Priority Data

May 11, 1977 [SE] Sweden ..... 7705513

[51] Int. Cl.[3] ..... D21C 9/10; G06F 15/46

[52] U.S. Cl. ..... 162/49; 162/DIG. 10; 422/62

[58] Field of Search ..... 162/49, DIG. 10, 238; 422/62

[56] References Cited

U.S. PATENT DOCUMENTS

| | | | |
|---|---|---|---|
| B 300,004 | 1/1975 | Putman | 162/238 |
| 3,486,971 | 12/1969 | Weyrick | 162/49 |
| 3,562,384 | 3/1972 | Sloman | 162/49 |
| 3,679,543 | 7/1972 | Rivers | 162/49 |
| 3,962,029 | 6/1976 | Wettermark et al. | 162/49 |

FOREIGN PATENT DOCUMENTS

| | | | |
|---|---|---|---|
| 2537143 | 3/1976 | Fed. Rep. of Germany | 162/49 |
| 321560 | 1/1972 | U.S.S.R. | 162/238 |

OTHER PUBLICATIONS

Casey; Pulp & Paper, vol. I Second Ed., Interscience Publishers, Inc., New York, 1960 pp. 426–427.

Burnett; "Computer Control of the Chlorine Stage"; Pulp & Paper Magazine of Canada, vol. 71, No. 14, Jul. 17, 1970.

*Primary Examiner*—Steve Alvo

[57] ABSTRACT

A method is provided for controlling the supply of delignifying and/or bleaching chemicals in the continuous delignification and/or bleaching of lignocellulosic material such as wood and pulp in a through flow delignification and/or bleaching stage which commprises admixing the lignocellulosic material with delignifying and/or bleaching chemicals and flowing the lignocellulosic material under delignifying and/or bleaching conditions through the stage while controlling the addition of the delignifying and/or bleaching chemicals according to the ratio of the quantity of delignifying and/or bleaching chemicals consumed to the quantity of delignifying and/or bleaching chemicals originally charged, referred to hereinafter as relative consumption, the time and the temperature in a manner to maintain substantially constant the relative consumption of delignifying and/or bleaching chemicals at a predetermined time by the lignocellulosic material during flow through the stage.

43 Claims, 4 Drawing Figures

PROCESS FOR CONTROLLING THE SUPPLY OF DELIGNIFYING AND/OR BLEACHING CHEMICALS IN THE CONTINUOUS DELIGNIFICATION OF LIGNOCELLULOSIC MATERIAL

The delignification of lignocellulosic material by chemical or chemimechanical techniques removes lignin and lignin-related materials from the lignocellulosic material in the mildest possible manner, in order to produce a cellulose pulp product which is as uniform and nondegraded as possible. Various chemical delignification procedures are used which result in the production of chemical pulps, among them the sulfite, sulfate and oxygen/alkali pulping processes.

Mechanical techniques in which the lignocellulosic material is treated by mechanical action including grinding and refining, which result in the formation of groundwood pulp, refiner pulp, and thermomechanical pulp. In the production of mechanical pulps, the objective is to retain the highest possible content of lignin in the pulp, but at the same time achieve a high degree of brightness.

After cellulose pulp has been obtained by chemical techniques, it can be further delignified by delignifying chemicals in a second delignification stage to remove the lignin residues which have not been dissolved during the first chemical treatment of the wood, and increase the brightness of the pulp. The second delignification is normally carried out as a bleaching stage, by treating the pulp with bleaching agents such as chlorine; chlorine dioxide; hypochlorite; peroxide; and oxygen and alkali such as sodium hydroxide, sodium carbonate, and sodium bicarbonate.

The objective in bleaching mechanical cellulose pulp is to increase the brightness of the pulp, while retaining as much as possible of the lignin content. Inorganic and organic peroxides and dithionites are typical reagents used in the bleaching of mechanical cellulose pulps on a commercial scale.

The chemical delignification of lignocellulosic material to form chemical or chemimechanical pulp utilizes delignifying chemicals which are recovered and recycled to the chemicals recovery stage. Similarly, the residual delignifying chemicals utilized in bleaching-/delignification stages are recovered and recycled to the chemicals recovery stage. In this way the chemicals cost is limited to the provision of fresh chemicals to replace the losses and attrition incurred during pulping-/delignification and bleaching/delignification stages. Generally, the proportion of chemicals recovered from the bleaching/delignification stages is less complete than chemicals recovery from pulping/delignification stages.

It is most important that the delignification utilize the delignifying chemicals supplied to the system as efficiently as possible, since then the delignification has the best possible effect per unit quantity of chemicals consumed. However, many of the chemicals required for delignification are consumed in different ways by different woods, because of variations in the chemical composition of the wood or pulp from batch to batch, as well as variations in the composition in the course of the delignification process, and this makes it difficult to control the charge of delignifying chemicals to the system.

The delignifying/bleaching chemicals consumed during bleaching/delignification constitute a very large part of the cost of the production of bleached cellulose pulp. The amount of delignifying/bleaching chemicals charged to a bleaching/delignification stage also affects the quality of the end product. Consequently, in the course of the bleaching/delignification stage it is important to correctly meter the amounts of chemicals charged to the bleaching/delignification system. This however is difficult to do, because of the variations in the lignin content of the wood, and in the amount of chemicals required to attack it. Moreover, difficulties are encountered because of the long residence time of the pulp in the bleaching stage.

The protection of the environment against pollution as a result of the emission of harmful byproducts of the delignification/bleaching reactions requires recycling of the waste chemicals and liquors. The screening and washing sections must be made a part of the recovery system, if the waste liquors therefrom are not to be discharged as pollutants, which means that the impurities and washing residues accompany the pulp to the bleaching/delignification section, instead of being discharged from the system.

Variations in the completeness of the pulping of the lignocellulosic material and of the washing of the pulp introduce variations in the lignin content in the flow of cellulose pulp arriving at the bleaching stage, as well as the proportion of lignin dissolved in the liquor, and the proportion of lignin still bound to the cellulose fibers. Moreover, residual chemicals accompanying the pulp to the bleaching stage, such as pulping chemicals which have not been washed out, may react with and consume the bleaching chemicals.

To control delignifying chemicals addition in the delignification of cellulose pulp, one must take into account the fact that the charged delignifying chemicals react not only with lignin bound to the cellulose, but also with chemical consuming substances dissolved in the liquor. This considerably complicates control of the amount of chemicals added, since it is difficult to determine how much of the added chemicals will react with lignin in the desired way, and how much will be diverted and wasted because of side reactions with chemicals dissolved in the liquor.

A number of methods have been proposed for controlling the supply of delignifying/bleaching chemicals in bleaching/delignification, in an attempt to conform to the requirements of the particular cellulose pulp being treated:

(A) In this method, the supply of delignifying/-bleaching chemicals to the system is varied according to the content of residual chemicals in the pulp upon completion of the delignification. To achieve this, the quantity of residual chemicals, for example, active chlorine compounds present and dissolved in the residual liquor, is determined manually at given intervals. Because of the variations in the properties of the pulp, and because of the long residence time during bleaching, the delignifying/bleaching chemicals must be charged in quantities which are greater than required, in order to ensure a satisfactory delignification, but this results in an adverse effect on the quality of the pulp, and unnecessarily high delignification chemical costs.

(B) In this method, the supply of delignifying/bleaching chemicals to the system is varied according to the content of residual chemicals present in the pulp suspension, a short period of time after the delignification has begun. In this approach, the chemicals are charged in a manner such that the value measured, i.e., the residual chemicals content, redox potential, polarographic analysis, or optical signal, is maintained constant at the point in the system where the measurement was taken. This technique is referred to as set-point control. The desired set-point value can, when required, be corrected on the basis of residual chemical analysis carried out manually, subsequent to the completion of the bleaching/delignification.

This method provides for more rapid correction and adjustment of the addition of delignifying/bleaching chemicals than the first method, but does not pay sufficient regard to variations in the content of the pulp suspension. The method does not correctly take into account the fact that chemicals are consumed not only by the pulp but also by reactive substances dissolved in the liquor.

(C) In this method, the supply of delignifying/bleaching chemicals to the system is varied according to set-point control as described above, but the set-point value is changed when necessary on the basis of the measurements obtained from an automatic analysis of residual chemicals subsequent to completion of the delignification. This method is an improvement on the previously described set-point control, but still does not properly accommodate variations in the pulp suspension.

(D) In this method, the supply of delignifying/-bleaching chemicals to the system is varied according to the amount of delignifying/bleaching chemicals that react with chemicals present in the pulp suspension liquor, determined prior to charging the delignifying/-bleaching chemicals to the system, and according to the content of residual unconsumed delignifying/bleaching chemicals in the pulp suspension liquor, determined subsequent to charging the delignifying/bleaching chemicals to the system, after a given reaction time has elapsed.

This approach makes it possible to charge the delignifying/bleaching chemicals to the system in more precise quantities than any of the previous methods.

In order to operate properly under any of these four approaches, the temperature and residence time must be kept constant during the delignification/bleaching process, or varied in some manner correlated with the delignifying/bleaching chemicals addition.

(E) In this method, the addition of delignifying/-bleaching chemicals is controlled to the pulp suspension according to the lignin contents of the influent pulp and the effluent pulp. Any change required is effected by correcting the set-point value with the aid of analysis. Normally, a computer is required in order that the complicated calculations and adjustment in the supply can be effected rapidly and continuously. The method still requires a considerable staff, in the lignin content is to be determined with sufficient accuracy at sufficiently short intervals. It is however extremely difficult to determine the consistency of the pulp in a stream of pulp suspension with the accuracy and precision required for the operation of a cellulose pulp mill.

(F) This method controls the addition of delignifying/bleaching chemicals to the system according to the ratio of the content of residual unconsumed chemicals taken initially and after a given reaction time has elapsed. This method requires extremely accurate determinations at two locations, which necessarily must be made continuously. Normally, the delignification rate drops rapidly at the beginning of the delignification reaction. Hence, the values measured will lie very close to one another, in a magnitude which increases the accuracy requirement, since it is difficult to detect the difference, with the result that it is virtually impossible to reach the precision required by this approach utilizing known analytical techniques. Moreover, the relationship is not a good control parameter under most circumstances.

Combinations of these various approaches have been proposed, but they also have disadvantages. *TAPPI* 58 (3) March, 1975, pp. 91 to 94, suggests a method in which there are used two determinations of the residual chlorine content, combined with a computer calculation of the lignin content of the influent pulp, in order to regulate chlorine flow. In this case, it has been assumed that it is possible to regulate the pulp flow with sufficient accuracy, but this is not possible, with the available sensors for determining pulp consistency.

In the regulation of the supply of delignifying/-bleaching chemicals to a system in accordance with the above approaches, it is not in reality the actual result of the bleaching/delignification of the cellulose pulp which is being measured. This is due to the fact that it is extremely difficult to analyze the cellulose pulp in an exact manner without a large staff. It is therefore implied that the supply of delignifying/bleaching chemicals is regulated in a manner such that the desired final result is obtained.

Moreover, of the available methods, only the fourth, method D, makes it possible to take into account the delignifying/bleaching chemicals consumption by the chemical consuming substances present in the influent liquor. The other methods seek to maintain a constant residual chemicals content at the measuring location, which is not a proper approach, since this should not be constant in orde to obtain a uniform bleaching/delignification, and where it is constant, it means that the bleaching/delignification will not be uniform, because of variations. The fourth method is too complicated, however, to be practical in most cellulose pulp mills.

The process of the invention avoids the disadvantages of these prior processes, and is much simpler to apply than the fourth approach, while at the same time taking into account the consumption of delignifying/-bleaching chemicals by the chemical consuming substances present in the liquor. The process of the invention is a continuous flow process, in which there is a throughput of pulp suspsension through a pulping-/delignification or bleaching/delignification stage, with addition of delignifying chemicals at at least one location to the delignification.

In the process of the invention, the delignifying and-/or bleaching (referred to hereinafter generically as delignification/bleaching) chemicals are charged to the system, such as to a stream of lignocellulosic material, wood chips, or pulp or pulp suspension, in an amount so adjusted according to the ratio of the quantity of delignifying/bleaching chemicals consumed and the quantity of the delignification/bleaching chemicals originally charged that the relative consumption of delignifying/-bleaching chemicals is maintained substantially constant. This can be done by determining the weight of delignifying/bleaching chemicals charged; determining the weight of residual unconsumed delignifying/bleaching chemicals at some stage during or after the delignification/bleaching of the lignocellulosic material such as a pulp suspension; from these determinations determining the relative consumption of delignifying/bleaching chemicals during the delignification/bleaching reaction; and then adjusting the addition of delignifying/-bleaching chemicals to the delignification/bleaching in a manner to maintain relative consumption of delignifying/bleaching chemicals substantially constant at a level corresponding to the desired degree of delignification/bleaching.

The process of the invention is applicable to each of the following delignification/bleaching processes:

(1) Pulping of wood, i.e., delignification of lignocellulosic material. This is referred to hereinafter as pulping-/delignification.

(2) Bleaching of pulp in the sense that the lignocellulosic material is delignified, i.e., decreasing the lignin content and also increasing the brightness. This is referred to hereinafter as bleaching/delignification.

(3) Bleaching of pulp in the sense that the brightness of the lignocellulosic material is increased, while retaining as much as possible of the lignin content, and possibly the entire content of lignin. This is referred to hereinafter as bleaching.

These can all be regarded as delignification and/or bleaching (i.e., delignification/bleaching) processes, inasmuch as each includes at least some delignification and/or bleaching, and hence are referred to generically herein as delignification/bleaching processes. These processes can of course be applied severally and sequentially to the same batch of lignocellulose material as it progresses to the finished cellulose pulp stage.

Figure 1:
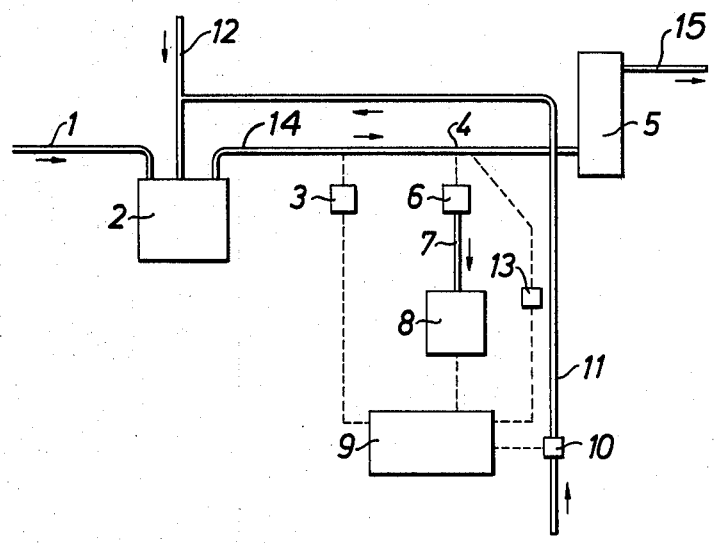
FIG. 1 is a flow sheet of the continuous through-flow bleaching/delignification section of a pulp processing plant.

It is desirable to determine the content of residual delignifying/bleaching chemicals as soon as possible after the delignifying/bleaching chemicals have been charged to the lignocellulosic material, such as the pulp suspension, to allow for prompt correction of the additions of delignifying/bleaching chemicals to the lignocellulosic material. The consumption of the delignifying/bleaching chemicals begins immediately after the addition, the amount consumed for a predetermined time interval thereafter being dependent upon the chemicals and the process. The content of delignifying/bleaching chemicals can be determined at any time interval after the chemicals have been charged, before the chemicals have been entirely consumed, for example, a few minutes thereafter, up to several hours. The determination can even be delayed until the end of the delignification/bleaching if the delignifying/bleaching chemicals are not entirely consumed in the course of the delignification/bleaching. In general, the determination should be made at a stage of the delignification/-bleaching where the relative chemicals consumption in percent (i.e., the ratio×100) is within the range from about 1 to about 99.9%, suitably from about 25 to about 99.5%, and preferablyfrom about 40 to about 99.0% , of delignifying/bleaching chemicals originally charged.

The content of delignifying chemicals is determined at a time within the ranges set forth below:

| | Ranges (time in minutes) | | |
|---|---|---|---|
| | Overall | Suitable | Preferable |
| Pulping/delignification | From about 5 to about 600 | From about 30 to about 480 | From about 100 to about 360 |
| Bleaching/delignification | From about 0.05 to about 240 | From about 0.5 to about 160 | From about 1.5 to about 100 |
| Bleaching | From about 0.05 to about 600 | From about 0.5 to about 480 | From about 1.5 to about 360 |

The ranges encompass variations according to the type of process, i.e., delignification in pulping, delignification in bleaching, and bleaching. As an example, the relative consumption in pulping is about 25% after thirty minutes, while in delignification and bleaching of pulp the consumption is about 25% after thirty seconds.

In accordance with the invention, the relative consumption of delignifying/bleaching chemicals is established at a value corresponding to the desired degree of delignification/bleaching, and is maintained constant so as to maintain uniform this desired degree of delignification/bleaching. This can accordingly be regarded as a set-point for the relative consumption of delignifying/-bleaching chemicals. The set-point for this relative consumption is selected from an empirically established relationship between the relative consumption of delignifying/bleaching chemicals the degree of delignification/bleaching. Example 1 is an illustration of this. The degree of delignification can be in terms of a selected Kappa number, chlorine number, or other measurement correlated with the content of lignin in the cellulose pulp, or the brightness of or light absorption coefficient of the cellulose pulp.

The addition of delignifying/bleaching chemicals in accordance with the invention is controlled with reference to delignification/bleaching temperature and/or delignification/bleaching time. These variables can be maintained constant during the delignification/bleaching; if they are not maintained constant, then variations in these parameters should be compensated for in the controls. Such compensation can be based on mathematical models, resulting from theories on chemical reaction kinetics, or purely empirical mathematical models can be used.

In the process of the invention, accordingly, the addition of delignifying/bleaching chemicals is so regulated that a selected set-point for the relative consumption of delignifying/bleaching chemicals $RC_{SET}$ is maintained constant. The real or actual relative consumption $RC_M$ of delignifying chemicals for a given delignification time is determined as the ratio between the quantity of delignifying/bleaching chemicals consumed and the quantity of delignifying/bleaching chemicals originally charged.

To calculate $RC_M$ according to the invention, the quotient of (1) the difference in the weight quantity of delignifying/bleaching chemicals (F) charged minus the weight of residual delignifying/bleaching chemicals (V×C) divided by (2) the weight of added delignifying/bleaching chemicals (F) is calculated. The content of delignifying/bleaching chemicals, whether determined during and/or after the delignification/-bleaching, is C and V is the flow volume of the pulp suspension in the delignification/bleaching. Thus, the relative consumption in percent of delignifying/bleaching chemicals for a given time $RC_M$ is represented by the following equation:

$$RC_M = \frac{F - V \times C}{F} \times 100$$

To obtain a ratio not expressed as percent, the $\times 100$ is omitted.

Since the weight of delignifying/bleaching chemicals F charged to the system is determined initially, and the amount of chemicals consumed cannot be determined until the point in time selected for the determination of the consumption has been reached, $RC_M$ cannot be calculated immediately. When the analyses are being carried out continuously, however, as an approximation, it is possible to ignore the time lag in making the calculation, and utilize the analytical result taken at the time the weight of delignifying/bleaching chemicals is determined. Normally, if the time required for the suspension to flow to the point at which the analysis C is made is not greater than five minutes, this does not give rise to any serious discrepancies.

Utilizing the process in accordance with the invention, it is possible to obtain a uniform lignin content in the cellulose pulp, while at the same time obtaining an optimum yield and optimum strength. In the delignification of mechanical and semichemical pulp, a cellulose pulp of uniform brightness is obtained. In the delignification of chemical pulps, an equalization of the variation in the lignin content of the delignified pulp and the brightness of the pulp is obtained.

The process of the invention is applicable to the delignification/bleaching of any type of lignocellulosic material, including both softwoods, such as pine, spruce, juniper, redwood, cedar, hemlock, larch and fir, and hardwoods including beech, birch, poplar, gum, oak, maple, sycamore, olive, eucalyptus, aspen, cottonwood, bay, hickory and walnut. Such delignifications are referred to as pulping/delignification processes in a continuous delignification process in which the lignocellulosic material is passed continuously into the delignification zone at one end and withdrawn from the delignification zone at the other end.

The process of the invention is of particular application to the delignification/bleaching of lignocellulosic material which has been pulped utilizing chemical pulping procedures, such as the sulfite, sulfate, oxygen/alkali, bisulfite and soda pulping processes. The method according to the invention is applied with particular advantage to chemically produced pulps having a lignin content corresponding to a Kappa number within the range of approximately 100 to approximately 1, suitably from 50 to 2, and preferably from 50 to 2.5. However, the process of the invention is applicable to all types of pulps, including groundwood pulps, chip-refined pulps, thermomechanical pulps, chemimechanical pulps and semimechanical pulps.

The process of the invention is also of particular application to further delignification/bleaching of cellulose pulp prepared by any chemical, mechanical or chemimechanical pulping procedure. Such delignifications are referred to as bleaching/delignification processes. Any bleaching agent can be used, including the oxidizing bleaching agents such as chlorine, peroxides, such as hydrogen peroxide, sodium peroxide and peracetic acid, hypochlorous acid and chlorine dioxide, as well as reducing bleaching agents, including sodium dithionite, zinc dithionite, sodium borohydride, hydroxylamine and thioglycolic acid.

The process of the invention is preferably applied in an introductory bleaching stage, in which event in addition to improved brightness there is also obtained a further delignification. The method of the invention can also be applied to delignification/bleaching carried out in a plurality of stages, for example, a bleaching stage in which different bleaching chemicals are used in sequential stages, without intermediate extraction or washing.

The process according to the invention can also be applied when several delignification/bleaching chemicals are used simultaneously, such as, for example, in bleaching, using mixtures of chlorine and chlorine dioxide.

FIG. 1 is a flow sheet of the bleaching section of a continuous pulping plant utilizing chlorine as the delignifying chemical in a first bleaching stage. In this plant, a pulp suspension having a concentration between 2 and 4% is led from the pulping screening section (not shown) through a line 1 to a mixer 2, in which the suspension is mixed with chlorine entering via line 11 in a flow F. The valve 10 in line 11 controls the flow of chlorine or other delignifying/bleaching chemicals into the mixer 2. The homogeneity of the mixture is improved by supplying to the mixer 2 a strong ejector flow of water $V_e$ through line 12. The mixed suspension leaves the mixer via line 14, and the volumetric flow of the pulp suspension V from the mixer in line 14 is measured by a flowmeter 3. Beginning in the mixer 2, after the chlorine has been mixed with the pulp suspension, chlorine is consumed. When the pulp suspension reaches the position 4 in line 14, the residual content of chlorine is determined.

The delignification/bleaching reaction is allowed to continue thereafter while the pulp suspension is passed through the delignification vessel 5. The delignified pulp leaves vessel 5 via line 15 for further processing (not shown).

At position 4 is a sampling device 6, in which a liquid sample of the pulp suspension freed from fibers is separated. A stream of this sample is passed via line 7 to an analyzer 8, in which the content of residual chlorine C is determined. The temperature T of the pulp suspension in line 14 just beyond position 4 is measured by means of a temperature-measuring device 13. The signals from the flowmeter 3, the residual chlorine analyzer 8, and the temperature-measuring device 13 are sent to a computer 9. A control instruction is produced in the computer 9 on the basis of the measurements that are fed thereinto.

The lignin content L upon completion of the chlorine-bleaching delignification process is a function of the relative chlorine consumption RC, the reaction temperature T and the reaction time t, in accordance with the equation $L = f_1(RC, T, t)$. When the temperature and time are constant, L is $f_2$ (RC). When RC is constant, the lignin content after the chlorine bleaching process is also constant.

The value of RC which can be used is dependent upon reaction time and reaction temperature. The temperature T is known, and the reaction time t can be calculated, since it is inversely proportional to the flow V of pulp suspension. A set-point regarding the relative chlorine consumption $RC_{SET}$ can be established with the aid of a mathematical calculation. In this respect, the control model may have, for example, the following appearance, in which V is the volumetric flow of pulp suspension in the delignification reaction; T is the temperature during the reaction and $L_{SET}$ is the desired lignin content expressed as Kappa number. K1, $K_2$, $K_3$, $K_4$, $K_5$ and $K_6$ are constants.

These constants are preferably determined by a sequence of tests in the laboratory, where various amounts of delignifying/bleaching chemicals are added to the pulp at different temperatures, with analysis of the content of residual chemicals at different times. After a determined reaction time at which the degree of delignifying/bleaching is determined by the position of the stage in the bleaching sequence and the desired effect of the stage, the lignin content of the pulp is analyzed. The relative consumption of delignifying/-bleaching chemicals is calculated as the ratio of the amount of delignifying/bleaching chemicals consumed, i.e., the charged amount minus the residual amount, and amount of delignifying/bleaching chemicals are charged. With these known data, i.e., time, temperature and lignin content of the pulp, and their multiples as independent variables, and the relative consumption the charged chemicals as a dependent variable, the constants $K_1$, $K_2$, $K_3$, $K_4$, $K_5$ and $K_6$ can be determined by multiple regression, which is a statistical method of mathematics for adjustment of determined and mutually connected test results.

$$RC_{SET}=K_1+K_2\times(1/V)+K_3\times(1/V^2)+K_4\times T+K_5\times L_{SET}+K_6\times(L_{SET})^2$$

The relevant real-value concerning relative consumption $RC_M$ is calculated as follows: The volumetric flow of pulp suspension in line 14 is measured to V $m^3$/minute. The chlorine flow to the pulp suspension in line 11 is F kg/minute. The residual content of chlorine in the sample at 4 is determined as C g/1. From this there is obtained $$RC_M=\frac{F-V\times C}{F}$$

The control instruction for changing the chlorine flow is obtained on the basis of the relationship $$F_{SET}=F_M-K\times(RC_{SET}-RC_M),$$

where $F_{SET}$ is the chlorine flow which should be set, $F_M$ is the real value of the chlorine flow, and K is a constant. This relationship is used to regulate the flow of chlorine to the mixer 2 via line 11 at valve 10, which controls the flow of chlorine, and is opened or closed in a manner such that $RC_M=RC_{SET}$, which applies when $F_M=F_{SET}$.

The magnitude of the chlorine flow thus obtained is precisely that required to obtain the desired lignin flow after the delignification/bleaching. An appreciable improvement in precision is obtained by regulating the weight of delignifying/bleaching chemicals added in the process of the invention, and this with only a single analysis of the pulp suspension. It is also possible to establish a total flow of lignin to the chlorine bleaching stage, since the chlorine flow is a direct function of the lignin flow. If the consistency of the pulp is constant, the process of the invention can be used to determine the lignin content, as a result of which there is obtained for the first time an automatic Kappa number analyzer, a considerable advantage over previous approaches utilizing analyses of samples taken manually.

The pulp suspension can be analyzed to determine the residual content of delignifying/bleaching chemicals after the chemicals have been mixed in the pulp, and the delignification/bleaching reaction begun, in a number of different ways. Examples of the known available methods include redox potential measurement; polarographic measurement; conductivity or pH measurement; manual or automatic iodotitrations; and manual or acid base titrations of the content of residual delignifying/bleaching chemicals. Preferably the analysis is carried out continuously, and is specific for the delignification/bleaching chemicals which it is desired to analyze.

It has been found particularly desirable to utilize a fiber-free sample taken from the pulp suspension liquor at position 4. This sample is caused to react with a suitable reagent to liberate heat, and the heat thus liberated is utilized as a measure of the residual content of the delignifying/bleaching chemical, in accordance with prior determinations of known samples, producing known quantities of heat. In accordance with the procedure of U.S. Pat. No. 3,888,726, patented June 10, 1975, by suitable selection of the reagent it is possible in this way to analyze, for example, sodium hydroxide, sodium sulfite, sodium carbonate, sodium hypochlorite, chlorine, chlorine dioxide and hydrogen peroxide, and also other delignification chemicals. In certain delignifying processes, mixtures of delignifying agents are used, and it is possible to analyze chlorine and chlorine dioxide in admixture.

The following Examples in the opinion of the inventors represent preferred embodiments of the invention. Example 1 illustrates controlling the flow of chlorine to the chlorinating stage, in order to obtain a uniform lignin content of the pulp suspension, applied to pine sulfate pulp. Example 2 illustrates the same for pine sulfite pulp delignification of pine sulfate pulp. Example 3 illustrates control of alkali flow to the alkaline/oxygen, and Example 4 illustrates the alkaline flow to the sulfate digestion of birch chips.

For purposes of comparison of the results obtained from the regulation of a chlorinating process in accordance with the invention, the control systems of the prior art have been followed in these ways: by maintaining the residual chlorine content constant, in one case three minutes after charging the chlorine; in another at the end of the chlorinating process; and in a third, after a certain reaction time has elapsed. These controls are designated in the Examples according to the following scheme:

I. Control with constant relative chlorine consumption, RC, according to the invention.

II. Control by constant residual content of active chlorine shortly after charging the chlorine (Method B or C above).

III. Control through constant residual content of active chlorine at the end of the chlorinating process (Method A above).

IV. Control through constant relationship between two residual chlorine contents after a given reaction time has elapsed, illustrated in Example 2 (Method F above).

EXAMPLE 1

Unbleached pine sulfate pulp was chlorinated in the plant for which a flow sheet is provided in FIG. 1. The Kappa number of the unbleached sulfate pulp was within the range from 27.1 to 38.6, and subsequent to chlorination the lignin content was determined by Kappa number analysis. Over successive one-day periods, the chlorine stage in the CEHDED bleaching of the pine sulfate pulp was controlled in accordance with Controls I, II and III, in that order, Control I according to the invention being used during the first day, Control II during the second day, maintaining a constant residual content of chlorine determined at a point shortly after the chlorine was charged to the system, and during the third day Control III was used, maintaining a constant residual content of chlorine determined at the end of the chlorination.

Figure 2:
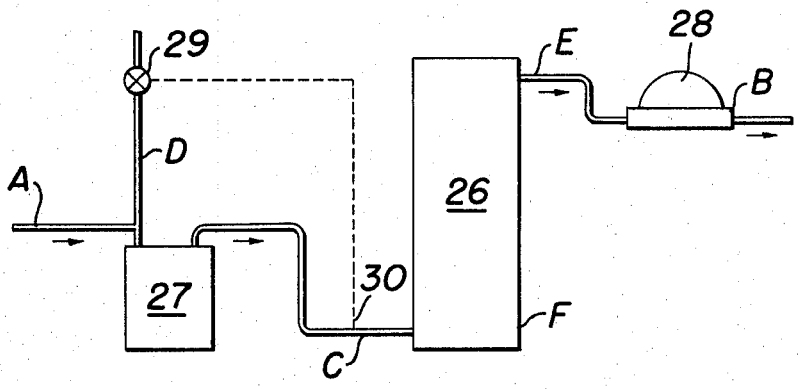
FIG. 2 is a flow sheet representing a variation in the flow arrangement of the continuous through-flow bleaching/delignification section of the pulp plant of FIG. 1.

FIG. 2 shows in flow sheet form the arrangement of the chlorine stage and measuring apparatus. The system includes a chlorinating tower 26, a chlorine mixer 27, a dewatering filter 28 arranged downstream of the chlorinating tower, a manual or automatically controllable valve 29 for supplying chlorine, and a redox potentiometer 30.

The following conditions were observed during the entire three-day period:

| | |
|---|---|
| Volumetric flow of pulp | 15,000 l/minute |
| Pulp concentration | 3.5% |
| Temperature | 26° C. |
| Residence time in chlorine stage | 45 minutes |
| Flow of chlorine | From 33 to 43 kg/minute |

Samples were taken every fifteen minutes of the unbleached pump at position A and of the chlorinated pump at position B in the chlorinating stage, in order to determine the lignin content (see FIG. 2). The pulp from position B was alkali-extracted at a pulp concentration of 12% and a temperature of 65° C. for two hours at a pH of 11. The lignin content was determined by Kappa number analysis according to SCAN C 1:59.

The following summary gives details of each Control run during the one day period:

CONTROL I

The residual chlorine content (C) was determined at position C by manual iodometric titration every five minutes. The flow of chlorine to the chlorinating stage $F_{Cl}$ at position D was determined at the same point of time. From the volumetric flow of pulp suspension (V), which was maintained constant, and the measured values of the flow of chlorine and residual chlorine content, the relative chlorine consumption (RC) was calculated in accordance with the followng equation:

$$RC = \frac{(F_{Cl} - V \times C) \times 100}{F_{Cl}}$$

The selected value of RC to be maintained constant was 75%. When the relative chlorine consumption exceeded this value, the amount of chlorine charged was increased by manually widening the valve 29, while when the amount of chlorine consumed tended to be lower than said value, the amount of chlorine charged was decreased by narrowing the valve 29. In this way, the RC value was maintained at about 75%.

CONTROL II

When this control was applied, the available plant installation of control equipment could be used. The Controls were operated so that the redox potential measured in position C was used to control the valve 29. When the redox value fell or increased, the chlorine charged was increased or decreased, respectively. In this way, the redox potential was maintained constant at position C. A check of the residual content by manual iodometric titration every fifteen minutes showed that the residual content of chlorine at position C was constant during the test period.

CONTROL III

In this Control the residual content of chlorine measured at the end of the chlorinating process was maintained constant, and was determined by manual iodometric titration at position E every five minutes. The amount of chlorine charged to the system was adjusted manually on the basis of the measured residual chlorine content by means of the valve 29, in a manner such that a residual chlorine content of 0.10% was obtained at position E, taking into account the long delay of forty-five minutes for the pulp to progress from the point at which the chlorine was charged to the system to the point at which the sample was removed at position E. When the residual content of chlorine at position E was too low, the amount of chlorine charged was increased by widening the valve 29, while when the residual content was too high, the amount of chlorine charged was reduced by narrowing the valve 29 somewhat.

The following results were obtained in terms of the resulting Kappa number, with the three Controls:

TABLE I

| | | Kappa number before the chlorinating stage | | | Kappa number after the chlorinating stage | | |
|---|---|---|---|---|---|---|---|
| | | | Range from mean value | | | Range from mean value | |
| Day | Control | Mean value | Absolute | % | Mean value | Absolute | % |
| 1 | I | 32.0 | ±4.3 | ±13.4 | 5.6 | ±0.1 | ±1.8 |
| 2 | II | 33.1 | ±4.1 | ±12.4 | 5.4 | ±0.9 | ±16.7 |
| 3 | III | 31.7 | ±3.9 | ±12.3 | 5.3 | ±0.6 | ±11.3 |

As will be evident from the above Table, the best results were obtained using Control I according to the invention. The range from the mean Kappa number before the chlorinating stage was approximately the same in all Controls, while the range from the mean Kappa number after the chlorinating stage using Control I according to the invention was only ±0.1 Kappa unit, as compared with ±0.6 Kappa unit when maintaining constant the residual chlorine content measured at the end of the chlorinating stage, Control III.

The differences in the mean Kappa number among the Example and the Control after the chlorinating stage may seem small, but if one continues the bleaching of the pulp in the other bleaching stages E H D E D with the same chemical charge in each stage, the difference is shown to be significant, since there is a pronounced difference in the brightness of the fully bleached pulps.

In Table II below, the brightness of the fully bleached pulps is shown:

TABLE II

| Control | Brightness % according to SCAN-C11:75 | |
|---|---|---|
| | Mean value | Range from mean value |
| I | 90.9 | ±0.5 |
| II | 91.1 | ±1.9 |
| III | 91.0 | ±1.6 |

The larger range from the mean value of the brightness in Controls II and III, compared to Control I according to the invention, cannot be tolerated, which means that the range from the mean value of the Kappa number obtained after the chlorinating stage in some way must be compensated for. This is generally done by adding more chemicals in the subsequent stages, i.e., in the sequence E H D E D, than is necessary. In that way, one obtains a pulp with more even brightness, but on a higher level than what is necessary and desired. This means also that the cost of the delignifying and/or bleaching chemicals is higher than it need be. By the method according to the invention, it is possible to decrease the amount of chemicals added, and therefore also to decrease the cost of the chemicals.

EXAMPLE 2

Unbleached sulfite pulp was chlorinated in the plant of FIG. 1 using the variation shown in FIG. 2. The Kappa number of the unbleached sulfite pulp was within the range from 10.9 to 11.4, and subsequent to chlorination the lignin content was determined by F-205 analysis. In F-205 analysis, the pump is dissolved in phosphoric acid, and the solution analyzed in a spectrophotometer.

Over successive one-day periods, the chlorine stage in the CEHD bleaching of the spruce sulfite pulp was controlled in accordance with Controls I, II, III and IV, in that order, Control I according to the invention being used during the first day, Control II during the second day, maintaining a constant residual content of chlorine determined at a point shortly after the chlorine was charged to the system. During the third day Control III was used, maintaining a constant residual content of chlorine determined at the end of the chlorination, and, during the fourth day, Control IV was used, maintaining constant the relationship between two residual chlorine contents after a given reaction time has elapsed.

FIG. 2 shows in flow sheet form the arrangement of the chlorine stage and measuring apparatus. The system includes a chlorinating tower 26, a chlorine mixer 27, a dewatering filter 28 arranged downstream of the chlorinating tower, a manual or automatically controllable valve 29 for supplying chlorine, and a redox potentiometer 30.

The following conditions were observed during the entire three-day period:

| | |
|---|---|
| Volumetric flow of pulp | 11,000 l/minute |
| Pulp concentration | 3.5% |
| Temperature | 26° C. |
| Residence time in chlorine stage | 45 minutes |
| Flow of chlorine | From 8.8 to 9.9 kg/minute |

Samples were taken every fifteen minutes of the unbleached pulp at position A and of the chlorinated pulp at position B in the chlorinating stage, in order to determine the lignin content (see FIG. 2). The pulp from position B was alkali-extracted at a pulp concentration of 12% and a temperature of 65° C. for two hours at a pH of 11. The lignin content was determined by F-205 analysis.[1]

[1]An analytical technique based on UV absorption in the 2050 and 2800 Å wavelength range, according to *Pulp and Paper Magazine of Canada* May, 1957 pp 131–134 and determining lignin concentration. F205 = the extinction value × 1000 at a pulp concentration of 5 mg cellulose/ml dilute phosphoric acid (73.3 to 85.0%).

The following summary gives details of each Control run during the one day period:

CONTROL I

The residual chlorine content (C) was determined at position C by manual iodometric titration every five minutes. The flow of chlorine to the chlorinating stage F at position D was determined at the same point of time. From the volumetric flow of pulp suspension (V), which was maintained constant, and the measured values of the flow of chlorine and residual chlorine content, the relative chlorine consumption (RC) was calculated in accordance with the following equation:

$$RC = \frac{(F_{Cl} - V \times C) \times 100}{F_{Cl}}$$

The selected value of RC to be maintained constant was 75%. When the chlorine consumption exceeded this value, the amount of chlorine charged was increased by manually widening the valve 29, while when the amount of chlorine consumed tended to be lower than said value, the amount of chlorine charged was decreased by narrowing the valve 29. In this way, the RC value was maintained at about 75%.

CONTROL II

When this control was applied, the available plant installed of control equipment could be used. The controls were operated so that the redox potential measured in position C was used to control the valve 29. When the redox value fell or increased, the chlorine charged was increased or decreased, respectively. In this way, the redox potential was maintained constant at position C. A check of the residual content by manual iodometric titration every fifteen minutes showed that the residual content of chlorine at position C was constant during the test period.

CONTROL III

In this Control the residual content of chlorine measured at the end of the chlorinating process was maintained constant, and was determined by manual iodometric titration at position E every five minutes. The amount of chlorine charged to the system was adjusted manually on the basis of the measured residual chlorine content, by means of the valve 29 in a manner such that a residual chlorine content of 0.10% was obtained at position E, taking into account the long delay of forty-five minutes for the pulp to progress from the point at which the chlorine was charged to the system to the point at which the sample was removed at position E. When the residual content of chlorine at position E was too low, the amount of chlorine charged was increased by widening the valve 29, while when the residual content was too high, the amount of chlorine charged was reduced by narrowing the valve 29 somewhat.

CONTROL IV

In Control IV, the residual chlorine content was determined by manual iodometric titration every five minutes, partly at position C and partly at position F, a sampling location especially arranged for the test a short distance from the inlet at the bottom of the chlorinating tower. The quotient Q of the residual chlorine content was determined according to the following equation:

$$Q = \frac{\text{Residual chlorine content at position } F\ (RH_2)}{\text{Residual chlorine content at position } C\ (RH_1)}$$

This quotient Q was held constant at 0.8. The chlorine charged was manually regulated by adjusting the valve 29 every five minutes to provide the requisite charge which was calculated by the formula:

$$\Delta FC = 2[RH_2/RH_1] - 0.8$$

where ΔFC = the change in chlorine charged in kg/minute.

When the ratio between $RH_2$ and $RH_1$ is too low, ΔFC is negative, and the chlorine charge is decreased by manually adjusting the valve 29. When the ratio is too high, ΔFC is positive, and the chlorine charge is increased by manually adjusting the valve 29.

It was found to be extremely difficult to maintain Q at 0.8, due to the fact that it was necessary to make two residual chlorine content determinations, and the measured residual chlorine content values were very close to each other, of the order to magnitude of ~0.3 to 0.5 g/l in position C, and ~0.25 to 0.4 g/l in position F.

The following results were obtained in these four days of runs:

TABLE III

| | Kappa number before the chlorinating stage | | | F-205 Analysis after the chlorinating stage | | |
|---|---|---|---|---|---|---|
| | Mean | Range from the mean | | Mean | Range from the mean | |
| Control | value | Absolute | % | value | Absolute | % |
| I | 11.3 | ±3.2 | ±28.3 | 605 | ±8 | ±1.3 |
| II | 10.9 | ±2.7 | ±24.8 | 593 | ±57 | ±9.6 |
| III | 11.4 | ±3.1 | ±27.2 | 611 | ±33 | ±5.4 |
| IV | 11.1 | ±2.9 | ±26.1 | 573 | ±49 | ±8.6 |

As the Table shows, the best results are obtained when controlling the chlorine charged in accordance with the invention, Control 1, in which the range from the mean in F-205 analysis was by far the least. The next best result was obtained with Control III, while Controls II and IV gave the worst results.

The range from the mean value of F-205 in the different control methods is meaningful, as shown by the results in the range from the mean value of the brightness of the fully bleached pulps:

TABLE IV

| | Brightness % according to SCAN-C11:75 | |
|---|---|---|
| Control | Mean value | Range from mean value |
| I | 92.1 | ±0.4 |
| II | 92.6 | ±2.0 |
| III | 92.4 | ±1.6 |
| IV | 92.8 | ±1.9 |

The large range from the mean value of the pulp brightness in Controls II, III and IV leads, as in Example 1, to the addition of more chemicals in the later stages E H D than is necessary.

Thus, the method according to the invention minimizes the range from mean Kappa number of the pulp after, for example, the chlorination stage.

EXAMPLE 3

This Example shows that the Control method of the invention can be successfully applied to control delignification when bleaching pine sulfate pulp with oxygen gas and alkali. In these tests, the relative chemical consumption was determined by dividing the alkali (NaOH) consumed during the bleaching stage by the amount of alkali charged to the system at the beginning of the bleaching stage. The amount of unconsumed alkali at the end of the bleaching stage was determined by potentiometric titration. The lignin content prior to the oxygen stage and subsequent thereto was determined by Kappa number analysis.

The cellulose pulp was bleached with oxygen gas in all the tests for thirty-five minutes at a temperature of 100° C. and an $O_2$-pressure of 6 kp/cm$^2$. The Kappa number of the unbleached pulp was 35±6.

The results obtained from these tests are given in Table V:

TABLE V

| Run No. | Kappa number | Relative consumption of NaOH %, RC |
|---|---|---|
| 1 | 11.1 | 53.0 |
| 2 | 12.0 | 57.5 |
| 3 | 12.0 | 62.7 |
| 4 | 12.8 | 64.6 |
| 5 | 13.2 | 70.0 |
| 6 | 13.9 | 72.8 |
| 7 | 15.0 | 76.3 |
| 8 | 17.1 | 80.7 |
| 9 | 15.9 | 81.5 |
| 10 | 17.7 | 83.1 |
| 11 | 18.1 | 85.9 |
| 12 | 19.0 | 85.0 |
| 13 | 19.5 | 87.5 |

Figure 3:
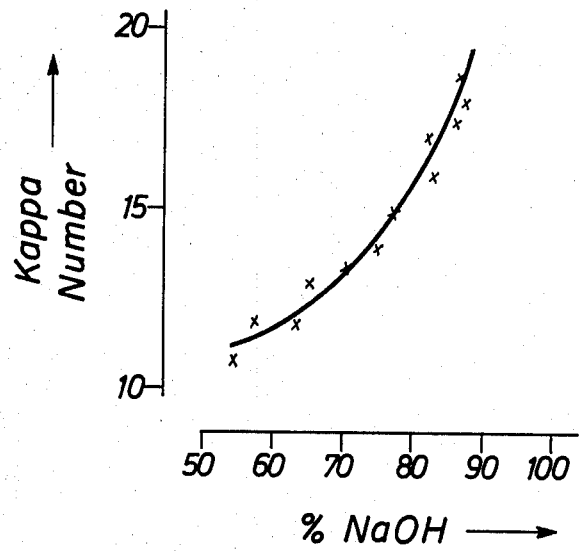
FIG. 3 is a graph showing the results obtained in Example 3, the Kappa number after the oxygen bleaching being plotted against percent relative NaOH consumption.

The data in table III are shown graphically in FIG. 3, in which the Kappa number after the oxygen stage has been plotted as the abscissa against the relative NaOH consumption during the oxygen stage in percent as the ordinate.

As shown by the data in Table III and in FIG. 3, there is a clear relationship between Kappa number after the oxygen stage and the relative NaOH consumption RC in the oxygen stage, since all the points for the Kappa number H fall on a curve represented by an equation of the form:

$$H = A_1(RC) + A_2(RC)^2 + A_3$$

It follows from this that the control method according to the invention can be applied to particular advantage in the delignification of pulp with oxygen gas.

EXAMPLE 4

This Example shows that the invention can be applied to advantage to control delignification during sulfate-digestion of birch chips. The cooks were carried out with different charges of active alkali added as NaOH. The charges were varied between 17 and 25% calculated as NaOH on dry wood.

After digestion for fifteen minutes at 150° C., samples of the cooking liquor were taken, and the quantity of residual active alkali as NaOH was determined by potentiometric titration. The chips were then further digested for seventy minutes at 150° C.

The relative alkali consumption was determined by dividing the consumed alkali as NaOH (the charged alkali minus the amount of residual alkali after fifteen minutes) with the charged alkali NaOH. The lignin content of the cellulose sulfate pulp was determined by Kappa number analysis.

The data obtained from these tests are given in Table VI:

TABLE VI

| Run No. | Kappa Number | Relative consumption of NaOH, %, RC |
|---|---|---|
| 1 | 16.8 | 22.0 |
| 2 | 17.0 | 23.3 |
| 3 | 17.5 | 24.8 |
| 4 | 18.1 | 28.1 |
| 5 | 19.4 | 29.4 |
| 6 | 20.0 | 29.9 |
| 7 | 20.0 | 31.1 |
| 8 | 20.8 | 31.8 |
| 9 | 22.7 | 32.7 |
| 10 | 22.0 | 32.9 |
| 11 | 22.9 | 34.3 |
| 12 | 24.5 | 36.0 |
| 13 | 24.0 | 37.1 |

Figure 4:
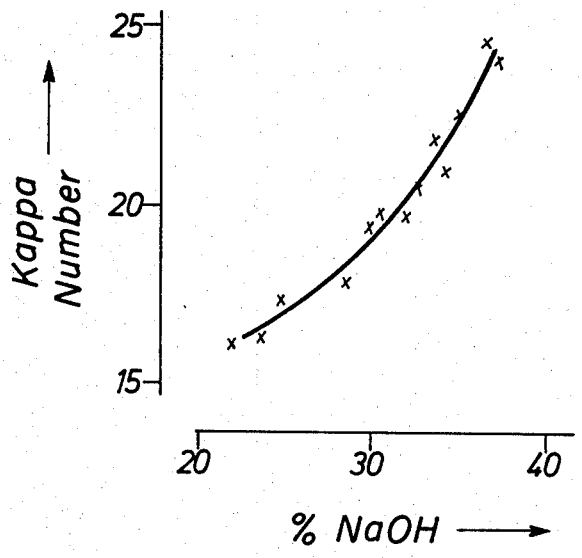
FIG. 4 is a graph showing the results obtained in Example 4, the Kappa number after the oxygen bleaching being plotted against percent relative NaOH consumption.

The data in Table IV are shown graphically in FIG. 4, in which the Kappa number after the cook is plotted as the abscissa against the relative alkali consumption as percent NaOH as the ordinate. As seen from Table IV and FIG. 4, a clear relationship was obtained between Kappa number H of the finished pulp and the relative consumption RC of NaOH, since the points of the Kappa number H all fell on a curve represented by an equation of the form:

$$H=B_1(RC)^2+B_2(RC)^2+B_3$$

It follows from this that the control method according to the invention can be applied to particular advantage to control delignification in sulfate digestion of wood.

Having regard to the foregoing disclosure, the following is claimed as inventive and patentable embodiments thereof:

1. A continuous flow process for the delignification of lignocellulosic material, in which there is a throughput of lignocellulosic material through a delignification stage, with addition of delignifying chemicals at at least one location to the delignification, which comprises adding delignifying chemicals to the system in an amount so adjusted according to the ratio for the quantity of delignifying chemicals consumed and the quantity of the delignification chemicals originally charged that the relative consumption of delignifying chemicals is maintained substantially constant.

2. A process according to claim 1, in which the delignification is a pulping delignification.

3. A process according to claim 1, in which the delignification is a bleaching delignification.

4. A process according to claim 1, in which the delignifying chemicals are added to a stream of lignocellulosic material.

5. A process according to claim 4, in which the lignocellulosic material is wood chips.

6. A process according to claim 4, in which the lignocellulosic material is cellulose pulp.

7. A process according to claim 4, in which the lignocellulosic material is an aqueous cellulose pulp suspension.

8. A process according to claim 1, which comprises determining the weight of delignifying chemicals charged; determining the weight of residual unconsumed delignifying chemicals at some stage during or after the delignification of the lignocellulosic material; from these determinations determining the relative consumption of delignifying chemicals during the delignification reaction; and then adjusting the addition of delignifying chemicals to the delignification in a manner to maintain relative consumption of delignifying chemicals substantially constant at a level corresponding to the desired degree of delignification.

9. A process according to claim 1, in which the lignocellulosic material is chemical cellulose pulp selected from the group consisting of sulfite, sulfate, oxygen-alkali, bisulfite and soda pulping processes.

10. A process according to claim 9, in which the chemical pulp has a lignin content corresponding to a Kappa number within the range of approximately 100 to approximately 1.

11. A process according to claim 1, in which the lignocellulosic material is cellulose pulp and the delignification is carried out with a bleaching agent selected from the group consisting of chlorine, peroxide, hypochlorous acid, chlorine dioxide, sodium dithionite, zinc dithionite, sodium borohydride, hydroxylamine and thioglycolic acid.

12. A process for controlling the supply of delignifying chemicals in the continuous delignification of lignocellulosic material in a through flow delignification stage, which comprises admixing the lignocellulosic material with delignifying chemicals and flowing the lignocellulosic material under delignifying conditions through the stage while controlling the addition of the delignifying chemicals according to the ratio of the quantity of delignifying chemicals consumed to the quantity of delignifying chemicals originally charged to the delignification, the temperature and the time in a manner to maintain substantially constant the relative consumption of delignifying chemicals at a predetermined time by the lignocellulosic material during flow through the stage.

13. A process according to claim 12, in which the consumption $RC_M$ of delignifying chemicals is determined as the quotient of (1) the difference in the weight quantity of delignifying chemicals (F) charged minus the weight of residual delignifying chemicals ($V \times C$) divided by (2) the weight of added delignifying chemicals (F), as represented by the equation:

$$RC_M = \frac{F - V \times C}{F} \times 100$$

wherein the content of delignifying chemicals, whether determined during or after the delignification is C, and V is the flow volume of the lignocellulosic material to the delignification.

14. A process according to claim 13, in which the amount of chemicals consumed is determined within five minutes after addition of the delignifying chemicals.

15. A process according to claim 13, in which the determinations are carried out simultaneously.

16. A process according to claim 12 in which the lignocellulosic material is analyzed to determine the residual content of delignifying chemicals after the chemicals have been mixed in the lignocellulosic material and the delignification reaction begun, by a method selected from the group consisting of redox potential measurement; polarographic measurement; conductivity or pH measurement; manual or automatic iodotitrations; and manual or acid base titrations of the content of residual delignifying chemicals.

17. A process according to claim 12, in which residual delignifying chemicals are determined after an amount within the range from 25% to about 99.5% of the amount of delignifying chemicals have been consumed.

18. A process according to claim 12, in which residual delignifying chemicals are determined after an amount within the range from 40 to about 99.0% of the amount of delignifying chemicals have been consumed.

19. A continuous flow process for the bleaching of lignocellulosic material, in which there is a throughput of lignocellulosic material through a bleaching stage, with addition of bleaching chemicals at at least one location to the bleaching, which comprises adding bleaching chemicals to the system in an amount so adjusted according to the ratio of the quantity of bleaching chemicals consumed and the quantity of the bleaching chemicals originally charged that the relative consumption of bleaching chemicals is maintained substantially constant.

20. A process according to claim 19, in which the bleaching chemicals are added to a stream of cellulose pulp.

21. A process according to claim 20, in which the cellulose pulp is an aqueous cellulose pulp suspension.

22. A process according to claim 19, which comprises determining the weight of bleaching chemicals charged; determining the weight of residual unconsumed bleaching chemicals at some stage during or after the bleaching of the lignocellulosic material; from these determinations determining the relative consumption of bleaching chemicals during the bleaching reaction; and then adjusting the addition of bleaching chemicals to the bleaching in a manner to maintain relative consumption of bleaching chemicals substantially constant at a level corresponding to the desired degree of bleaching.

23. A process according to claim 19, in which the lignocellulosic material is chemical cellulose pulp selected from the group consisting of sulfite, sulfate, oxygen-alkali, bisulfite and soda pulping processes.

24. A process according to claim 23, in which the chemical pulp has a lignin content corresponding to a Kappa number within the range of approximately 100 to approximately 1.

25. A process according to claim 19, in which the bleaching is carried out with a bleaching agent selected from the group consisting of chlorine, peroxide, hypochlorous acid, chlorine dioxide, sodium dithionite, zinc dithionite, sodium borohydride, hydroxylamine and thioglycolic acid.

26. A process for controlling the supply of bleaching chemicals in the continuous bleaching of cellulose pulp in a through flow bleaching stage, which comprises admixing the cellulose pulp with bleaching chemicals and flowing the cellulose pulp under bleaching conditions through the stage while controlling the addition of the bleaching chemicals according to the ratio of the quantity of bleaching chemicals consumed to the quantity of bleaching chemicals originally charged to the bleaching, the temperature and the time in a manner to maintain substantially constant the relative consumption of bleaching chemicals at a predetermined time by the cellulose pulp during flow through the stage.

27. A process according to claim 26, in which the consumption $RC_M$ of bleaching chemicals is determined as the quotient of (1) the difference in the weight quantity of bleaching chemicals (F) charged minus the weight of residual bleaching chemicals ($V \times C$) divided by (2) the weight of added bleaching chemicals (F), as represented by the equation:

$$RC_M = \frac{F - V \times C}{F} \times 100$$

wherein the content of bleaching chemicals, whether determined during and/or after the bleaching, is C, and V is the flow volume of the cellulose pulp to the bleaching.

28. A process according to claim 27, in which the amount of chemicals consumed is determined within five minutes after addition of the bleaching chemicals.

29. A process according to claim 26, in which the determinations are carried out simultaneously.

30. A process according to claim 26, in which the cellulose pulp is analyzed to determine the residual content of bleaching chemicals after the chemicals have been mixed in the pulp and the bleaching reaction begun, by a method selected from the group consisting of redox potential measurement; polarographic measurement; conductivity or pH measurement; manual or automatic iodotitrations; and manual or acid base titrations of the content of residual bleaching chemicals.

31. A process according to claim 26, in which residual bleaching chemicals are determined after an amount within the range from 25% to about 99.5% of the amount of bleaching chemicals have been consumed.

32. A process according to claim 26, in which residual bleaching chemicals are determined after an amount within the range from 40 to about 99.0% of the amount of bleaching chemicals have been consumed.

33. A continuous flow process for the pulping of lignocellulosic material, in which there is a throughput of lignocellulosic material through a pulping stage, with addition of pulping chemicals at at least one location to the pulping, which comprises adding pulping chemicals to the system in an amount so adjusted according to the ratio of the quantity of pulping chemicals consumed and the quantity of the pulping chemicals originally charged that the relative consumption of pulping chemicals is maintained substantially constant.

34. A process according to claim 33, in which the pulping chemicals are added to a stream of lignocellulosic material.

35. A process according to claim 34, in which the lignocellulosic material is wood chips.

36. A process according to claim 33, which comprises determining the weight of pulping chemicals charged; determining the weight of residual unconsumed pulping chemicals at some stage during or after the pulping of the lignocellulosic material; from these determinations determining the relative consumption of pulping chemicals during the pulping reaction; and then adjusting the addition of pulping chemicals to the pulping in a manner to maintain relative consumption of pulping chemicals substantially constant at a level corresponding to the desired degree of pulping.

37. A process for controlling the supply of pulping chemicals in the continuous pulping of lignocellulosic material in a through flow pulping stage, which comprises admixing the lignocellulosic material with pulping chemicals and flowing the lignocellulosic material under pulping conditions through the stage while controlling the addition of the pulping chemicals according to the ratio of the quantity of pulping chemicals consumed to the quantity of pulping chemicals originally charged to the pulping, the temperature and the time in a manner to maintain substantially constant the relative consumption of pulping chemicals at a predetermined time by the lignocellulosic material during flow through the stage.

38. A process according to claim 37, in which the consumption $RC_M$ of pulping chemicals is determined as the quotient of (1) the difference in the weight quantity of pulping chemicals (F) charged minus the weight of residual pulping chemicals (V×C) divided by (2) the weight of added pulping chemicals (F), as represented by the equation:

$$RC_M = \frac{F - V \times C}{F} \times 100$$

wherein the content of pulping chemicals, whether determined during and/or after the pulping, is C, and V is the flow volume of the lignocellulosic material to the pulping.

39. A process according to claim 38, in which the amount of chemicals consumed is determined within five minutes after addition of the pulping chemicals.

40. A process according to claim 37, in which the determinations are carried out simultaneously.

41. A process according to claim 32, in which the lignocellulosic material is analyzed to determine the residual content of pulping chemicals after the chemicals have been mixed in the lignocellulosic material and the pulping reaction begun, by a method selected from the group consisting of redox potential measurement; polarographic measurement; conductivity or pH measurement; manual or automatic iodotitrations; and manual or acid base titrations of the content of residual pulping chemicals.

42. A process according to claim 32, in which residual pulping chemicals are determined after an amount within the range from 25% to about 99.5% of the amount of pulping chemicals have been consumed.

43. A process according to claim 32, in which residual pulping chemicals are determined after an amount within the range from 40 to about 99.0% of the amount of pulping chemicals have been consumed.

* * * * *

UNITED STATES PATENT AND TRADEMARK OFFICE

CERTIFICATE OF CORRECTION

PATENT NO. : 4,348,256

DATED : September 7, 1982

INVENTOR(S) : John Rickard Bergstrom

It is certified that error appears in the above—identified patent and that said Letters Patent is hereby corrected as shown below:

| | |
|---|---|
| Column 4, line 36 : | "orde" should be —order-- |
| Column 6, line 1 : | "preferably from" should be --preferably from -- |
| Column 9, line 22 : | omit "are" |
| Column 11, line 37 : | "pump" should be --pulp— |
| Column 11, line 38 : | "pump" should be --pulp-- |
| Column 13, line 31 : | "pump" should be --pulp-- |
| Column 16, line 37 : | "table" should be --Table-- |
| Column 16, line 46 : | "H" should be --K -- |
| Column 16, line 49 : | "H" should be —K -- |
| Column 17, line 27 : | "H" should be --K -- |
| Column 17, line 29 : | "H" should be —K -- |
| Column 17, line 32 : | "H" should be --K -- |
| Column 17, line 47 : | "for" should be -- of--. |

Signed and Sealed this

*Twelfth* Day of *March 1985*

[SEAL]

*Attest:*

DONALD J. QUIGG

*Attesting Officer* *Acting Commissioner of Patents and Trademarks*